US009984609B2

(12) United States Patent
Kim et al.

(10) Patent No.: US 9,984,609 B2
(45) Date of Patent: May 29, 2018

(54) DISPLAY DEVICE

(71) Applicant: Samsung Display Co., Ltd., Yongin-si, Gyeonggi-do (KR)

(72) Inventors: Kiseo Kim, Gongju-si (KR); Gee-Bum Kim, Suwon-si (KR); Jae-Kyoung Kim, Goyang-si (KR); Rangkyun Mok, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 298 days.

(21) Appl. No.: 14/826,580

(22) Filed: Aug. 14, 2015

(65) Prior Publication Data

US 2016/0217723 A1 Jul. 28, 2016

(30) Foreign Application Priority Data

Jan. 26, 2015 (KR) ..... 10-2015-0012302

(51) Int. Cl.

*G09G 5/02* (2006.01)
*G09G 3/20* (2006.01)
*G09G 3/32* (2016.01)

(52) U.S. Cl.

CPC ..... *G09G 3/2003* (2013.01); *G09G 3/32* (2013.01); *G09G 2320/0242* (2013.01);
(Continued)

(58) Field of Classification Search

CPC ..... G09G 3/32; G09G 3/34; H01L 21/02142; H01L 21/044; H01L 29/7869;
(Continued)

(56) References Cited

U.S. PATENT DOCUMENTS 7,333,117 B2 2/2008 Kim
2006/0119259 A1* 6/2006 Bae ..... H01L 27/3246 313/506

(Continued)

FOREIGN PATENT DOCUMENTS

JP 2004-266821 A 9/2004
JP 5589544 B2 8/2014

(Continued)

OTHER PUBLICATIONS

Hayes, Samuel P., "The Color Sensations of the Partially Color-Blind, a Criticism of Current Teaching", The American Journal of Psychology, vol. 22, No. 3 (Jul. 1911), pp. 369-407.*

(Continued)

*Primary Examiner* — Xiao Wu
*Assistant Examiner* — Sarah Lhymn
(74) *Attorney, Agent, or Firm* — Knobbe Martens Olson & Bear LLP

(57) ABSTRACT

A display device is disclosed. In one aspect, the display device includes an image source configured to generate image data comprising red, green, and blue data and a color-weakness determiner configured to generate color vision deficiency data comprising color-weakness information. The device also includes a color-weakness compensator configured to generate compensation data based on the image data and the color vision deficiency data and a display portion comprising a plurality of pixels each configured to emit light based on the compensation data. Each of the pixels includes first and second sub-pixels configured to emit light having a light-emitting color based on an electric field applied to the first or second sub-pixel and a third sub-pixel configured to emit light having a predetermined light-emitting color.

25 Claims, 8 Drawing Sheets

(52) U.S. Cl.
CPC ..... *G09G 2320/0606* (2013.01); *G09G 2320/0666* (2013.01); *G09G 2320/0693* (2013.01); *G09G 2340/06* (2013.01)

(58) Field of Classification Search
CPC . H01L 29/122; H01L 29/15; H01L 29/66439; H01L 29/66977; H01L 31/035209; H01L 31/035218; H01L 51/0062; H01L 27/3216
USPC ..... 345/581, 589, 590, 591, 593
See application file for complete search history.

(56) References Cited

U.S. PATENT DOCUMENTS

| | | | | |
|---|---|---|---|---|
| 2007/0236656 | A1* | 10/2007 | Jeong | H04N 9/68 351/159.24 |
| 2009/0039764 | A1* | 2/2009 | Cho | B82Y 10/00 313/504 |
| 2013/0003163 | A1* | 1/2013 | Nowatzyk | G02F 1/167 359/296 |
| 2014/0231753 | A1* | 8/2014 | Chen | H01L 27/322 257/40 |
| 2016/0070386 | A1* | 3/2016 | Yamamoto | G06F 3/044 345/174 |

FOREIGN PATENT DOCUMENTS

| | | | |
|---|---|---|---|
| KR | 10-1999-0065548 | A | 8/1999 |
| KR | 10-2005-0106299 | A | 11/2005 |
| KR | 10-0587333 | B1 | 6/2006 |
| KR | 10-0810268 | B1 | 2/2008 |
| KR | 10-2016-0030005 | | 3/2016 |
| WO | WO 03/060870 | A1 | 7/2003 |

OTHER PUBLICATIONS

Brovelli et al., "Electrochemical Control of Two-Color Emission from Colloidal Dot-in-Bulk Nanocrystals," *NANO Letters*, ACS Publications, © XXXX America Chemical Society, pubs.acs.org/NanoLett, 2014, pp. A-I.

Pogosova, Anahit, *Modeling of Human Color Vision System, Master's Thesis*, Department of Computer Science and Statistics, P.O. Box 111, FI-80101 Joensuu, Finland, 2007, All Pages.

* cited by examiner

FIG. 5A

| | Color Vision Deficiency Type Data(K) | | | | | | | | |
|---|---|---|---|---|---|---|---|---|---|
| LUT | Normal(0) | | | Red Deficiency(1) | | | Green Deficiency(2) | | |
| Compensation Sensitivity Data (S) | R | G | B | R | G | B | R | G | B |
| 0 | 1<br>0<br>0 | 0<br>1<br>0 | 0<br>0<br>1 | - | | | - | | |
| 1 | - | | | 1.18<br>-0.03<br>0 | -0.21<br>1.05<br>0 | 0.03<br>-0.02<br>1 | 1.17<br>-0.06<br>0 | -0.22<br>1.08<br>0 | 0.05<br>-0.02<br>1 |
| 2 | - | | | 1.4<br>-0.09<br>0 | -0.5<br>1.12<br>0 | 0.1<br>-0.03<br>1 | 1.37<br>-0.13<br>0 | -0.5<br>1.18<br>0 | 0.13<br>-0.05<br>1 |
| 3 | - | | | 1.69<br>-0.13<br>0 | -0.88<br>1.19<br>0 | 0.19<br>-0.06<br>1 | 1.64<br>-0.25<br>0 | -0.84<br>1.31<br>0 | 0.2<br>-0.06<br>1 |
| 4 | - | | | 2<br>-0.19<br>0 | -1.38<br>1.29<br>0 | 0.38<br>-0.1<br>1 | 1.99<br>-0.38<br>0 | -1.31<br>1.48<br>0 | 0.32<br>-0.1<br>1 |

M1

FIG. 5B $$\begin{bmatrix} R' \\ G' \\ B' \end{bmatrix} = \begin{bmatrix} \text{Color-Weakness} \\ \text{Compensation Matrix} \end{bmatrix} \times \begin{bmatrix} R \\ G \\ B \end{bmatrix}$$

DISPLAY DEVICE

INCORPORATION BY REFERENCE TO ANY PRIORITY APPLICATIONS

This U.S. non-provisional patent application claims priority under 35 U.S.C. § 119 of Korean Patent Application No. 10-2015-0012302, filed on Jan. 26, 2015, the contents of which are hereby incorporated by reference in its entirety.

BACKGROUND

Field

The described technology generally relates to a display device.

Description of the Related Technology

As society has developed rapidly in the information age, the prominence of a display device as a visual information transmission medium keeps increasing. The display needs to meet design requirements, such as low power consumption, thin profile, lightweight, high definition, etc. In recent years, a quantum dots light-emitting diode has been actively researched since the quantum dots light-emitting diode has favorable characteristics such as being slim, having high color purity, having long operation times, displaying with light-emitting material, etc.

A quantum dot is a semiconductor nano particle. A quantum dot light-emitting diode uses the quantum dot in a light-emitting layer instead of an organic light-emitting material. An organic light-emitting diode (OLED) pixel emits a single color, e.g., red, green, or blue, and thus, each OLED cannot emit a wide variety of colors. However, the quantum dot light-emitting device controls positions each at which an electron and a hole are coupled with each other to emit a spectrum of hues. Therefore, the QD-LED has high color reproducibility and high brightness compared to an OLED, and the QD-LED display has been considered as a next generation light source.

SUMMARY OF CERTAIN INVENTIVE ASPECTS

One inventive aspect relates to a display device that can secure color-weakness (dyschromatopsia) information and processing image data on the basis of the secured color-weakness information.

Another aspect is a display device including an image source generating image data including red, green, and blue data, a color-weakness judging unit generating color vision deficiency data including a color-weakness information of a user, a color-weakness compensating unit generating compensation data using the image data and the color vision deficiency data, and a display part including a plurality of pixels emitting a light on the basis of the compensation data. Each of the pixels includes first and second sub-pixels each controlling a light-emitting color of the light emitted therefrom in response to an electric field applied thereto and a third sub-pixel having a predetermined light-emitting color of the light emitted therefrom.

The color vision deficiency data include color vision deficiency type data of the user and compensation sensitivity data of the user.

The color-weakness judging unit generates the color vision deficiency data using a D-15 panel test algorithm.

The display part displays D-15 color plates, and the color-weakness judging unit receives an input of the user with respect to an arrangement of the color plates displayed on the display part and generates the color vision deficiency data of the user on the basis of the input given by the user.

The color-weakness judging unit generates the color vision deficiency data using a pseudoisochromatic plates test algorithm.

The display part displays a color perception test chart, and the color-weakness judging unit receives an input given by the user with respect to the color perception test chart and compares the input given by the user to the displayed color perception test chart to generate the color vision deficiency data of the user.

The color-weakness judging unit determines that whether the input given by the user corresponds to the color perception test chart, changes the compensation sensitivity data when the input given by the user does not correspond to the color perception test chart, changes the color vision deficiency type data in response to a color vision deficiency type of the user, which is determined depending on the color perception test chart not corresponding to the input given by the user, and generates the color vision deficiency data using a present compensation sensitivity data and a present color vision deficiency type data when the input given by the user corresponds to the color perception test chart.

Each of the first and second sub-pixels includes a first electrode, an electron transport region formed on the first electrode, a color control light-emitting layer formed on the electron transport region, a hole transport region formed on the color control light-emitting layer, a second electrode formed on the hole transport region, an insulating layer formed on the second electrode, and a color control electrode formed on the insulating layer.

The color control light-emitting layer is a quantum dot light-emitting layer.

The second electrode is an electric field transmissive electrode.

The color control electrode applies an electric field to the color control light-emitting layer to control the light-emitting color of the color control light-emitting layer.

The light-emitting color has a wavelength controlled in a range from a first wavelength to a second wavelength in response to the electric field.

The first wavelength corresponds to a green color and the second wavelength corresponds to a red color.

The first wavelength is about 500 nm and the second wavelength is about 800 nm.

The light-emitting color of the third sub-pixel is a blue color.

The color-weakness compensation unit compensates for the image data with reference to a look-up table in which a color-weakness compensation matrix corresponding to the color vision deficiency data.

The color-weakness compensation unit secures the color-weakness compensation matrix corresponding to the color vision deficiency data with reference to the look-up table, calculates the image data with the color-weakness compensation matrix to generate intermediate data, processes the intermediate data to allow the intermediate data to correspond to the first, second, and third sub-pixels, and generates the compensation data.

The intermediate data include compensated red data, compensated green data, and compensated blue data.

The color-weakness compensation matrix is an inverse matrix of daltonize matrix corresponding to the color vision deficiency data.

The compensation data include second electrode data about a voltage applied to the second electrode, color control electrode data about a voltage applied to the color control electrode, and the compensated blue data.

The second electrode data are calculated by the following equation 1 of C1=k1·(R'+G')/2, where the C1 denotes the second electrode data, the k1 denotes a constant determined depending on the light-emitting efficiency of the color control light-emitting layer, the R' denotes the compensated red data, and the G' denotes the compensated green data.

The second electrode data are calculated by the following equation 2 of C2=k2·(R'(R'+G'))+k3, where the C2 denotes the color control electrode data, the k2 denotes a constant determined depending on the light-emitting efficiency of the color control light-emitting layer, the k3 denotes a constant determined depending on a threshold voltage required to drive the color control light-emitting layer, R' denotes the compensated red data, and G' denotes the compensated green data.

The first and second sub-pixels have a brightness determined on the basis of the second electrode data, the light-emitting color of the first and second sub-pixels is determined on the basis of the color control electrode data, and a brightness of the third sub-pixel is determined on the basis of the compensated blue data.

Another aspect is a display device comprising: an image source configured to generate image data comprising red, green, and blue data; a color-weakness determiner configured to generate color vision deficiency data comprising color-weakness information; a color-weakness compensator configured to generate compensation data based on the image data and the color vision deficiency data; and a display portion comprising a plurality of pixels each configured to emit light based on the compensation data. Each of the pixels comprises: first and second sub-pixels configured to emit light having a light-emitting color based on an electric field applied to the first or second sub-pixel; and a third sub-pixel configured to emit light having a predetermined light-emitting color.

In the above display device, the color vision deficiency data comprises color vision deficiency type data of a user of the display device and compensation sensitivity data of the user.

In the above display device; the color-weakness determiner is further configured to generate the color vision deficiency data based on a panel test algorithm.

In the above display device, the panel test algorithm includes a D-15 panel test algorithm configured analyze a plurality of color plates arranged by the user and obtain the color-weakness information of the user.

In the above display device, the display portion is configured to display fifteen color plates, wherein the color-weakness determiner is further configured to i) receive a user input with respect to an arrangement of the color plates displayed on the display portion and ii) generate the color vision deficiency data of the user based on the user input.

In the above display device, the color-weakness determiner is further configured to generate the color vision deficiency data based on a pseudoisochromatic plates test algorithm.

In the above display device, the display portion is further configured to display a color perception test chart, wherein the color-weakness determiner is further configured to i) receive a user input with respect to the color perception test chart and ii) compare the user input to the displayed color perception test chart so as to generate the color vision deficiency data of the user.

In the above display device, the color-weakness determiner is further configured to: determine whether the user input corresponds to the color perception test chart, change the compensation sensitivity data and the color vision deficiency type data based on a color vision deficiency type of the user, when the user input does not correspond to the color perception test chart, and generate the color vision deficiency data based on present compensation sensitivity data and present color vision deficiency type data, when the user input corresponds to the color perception test chart.

In the above display device, each of the first and second sub-pixels comprises: a first electrode; an electron transport region formed over the first electrode; a color control light-emitting layer formed over the electron transport region; a hole transport region formed over the color control light-emitting layer; a second electrode formed over the hole transport region; an insulating layer formed over the second electrode; and a color control electrode formed over the insulating layer.

In the above display device, the color control light-emitting layer comprises a quantum dot light-emitting layer.

In the above display device, the second electrode comprises an electric field transmissive electrode.

In the above display device, the color control electrode is configured to apply an electric field to the color control light-emitting layer so as to control the light-emitting color of the color control light-emitting layer.

In the above display device, the wavelength of the light-emitting color is in the range from a first wavelength to a second wavelength based on the electric field.

In the above display device, the first wavelength corresponds to a green color, wherein the second wavelength corresponds to a red color.

In the above display device, the first wavelength is about 500 nm, wherein the second wavelength is about 800 nm.

In the above display device, the light-emitting color of the third sub-pixel is a blue color.

In the above display device, the color-weakness compensator is configured to compensate for the image data based on a look-up table including a color-weakness compensation matrix corresponding to the color vision deficiency data.

In the above display device, the color-weakness compensator is further configured to: obtain the color-weakness compensation matrix corresponding to the color vision deficiency data based on the look-up table, calculate the image data based on the color-weakness compensation matrix so as to generate intermediate data, and process the intermediate data such that the intermediate data corresponds to the first to third sub-pixels so as to generate the compensation data.

In the above display device, the intermediate data comprises compensated red, green and blue data.

In the above display device, the color-weakness compensation matrix comprises an inverse matrix of a daltonize matrix corresponding to the color vision deficiency data.

In the above display device, the compensation data comprises second electrode data corresponding to a voltage applied to the second electrode, color control electrode data corresponding to a voltage applied to the color control electrode, and the compensated blue data.

In the above display device, the color-weakness compensator is further configured to calculate the second electrode data based on the following Equation 1, $$C1=k1\cdot(R'+G')/2, \qquad \text{Equation 1}$$

where C1 denotes the second electrode data, k1 denotes a constant determined based on the light-emitting efficiency of the color control light-emitting layer, R' denotes the compensated red data, and G' denotes the compensated green data.

In the above display device, the color-weakness compensator is further configured to calculate the second electrode data based on the following Equation 2, $$C2=k2\cdot(R'/(R'+G'))+k3, \quad \text{Equation 2}$$

where C2 denotes the color control electrode data, k2 denotes a constant determined based on the light-emitting efficiency of the color control light-emitting layer, k3 denotes a constant determined based on a threshold voltage required to drive the color control light-emitting layer, R' denotes the compensated red data, and G' denotes the compensated green data.

In the above display device, the color-weakness compensator is further configured to: determine a brightness of the first and second sub-pixels based on the second electrode data, determine the light-emitting color of the first and second sub-pixels based on the color control electrode data, and determine a brightness of the third sub-pixel based on the compensated blue data.

In the above display device, the color-weakness information comprises dyschromatopsia information of a user of the display device.

According to at least one of the disclosed embodiments, since the display device displays the image processed on the basis of the color-weakness information of the user, color-weakness people can perceive the colors of the image displayed in a color screen.

BRIEF DESCRIPTION OF THE DRAWINGS

FIG. 5A is view showing a look-up table storing color weakness compensation matrix corresponding to color vision deficiency data.

FIG. 5B is a view showing a determinant to generate intermediate data using image data.

DETAILED DESCRIPTION OF CERTAIN INVENTIVE EMBODIMENTS

Figure 1:
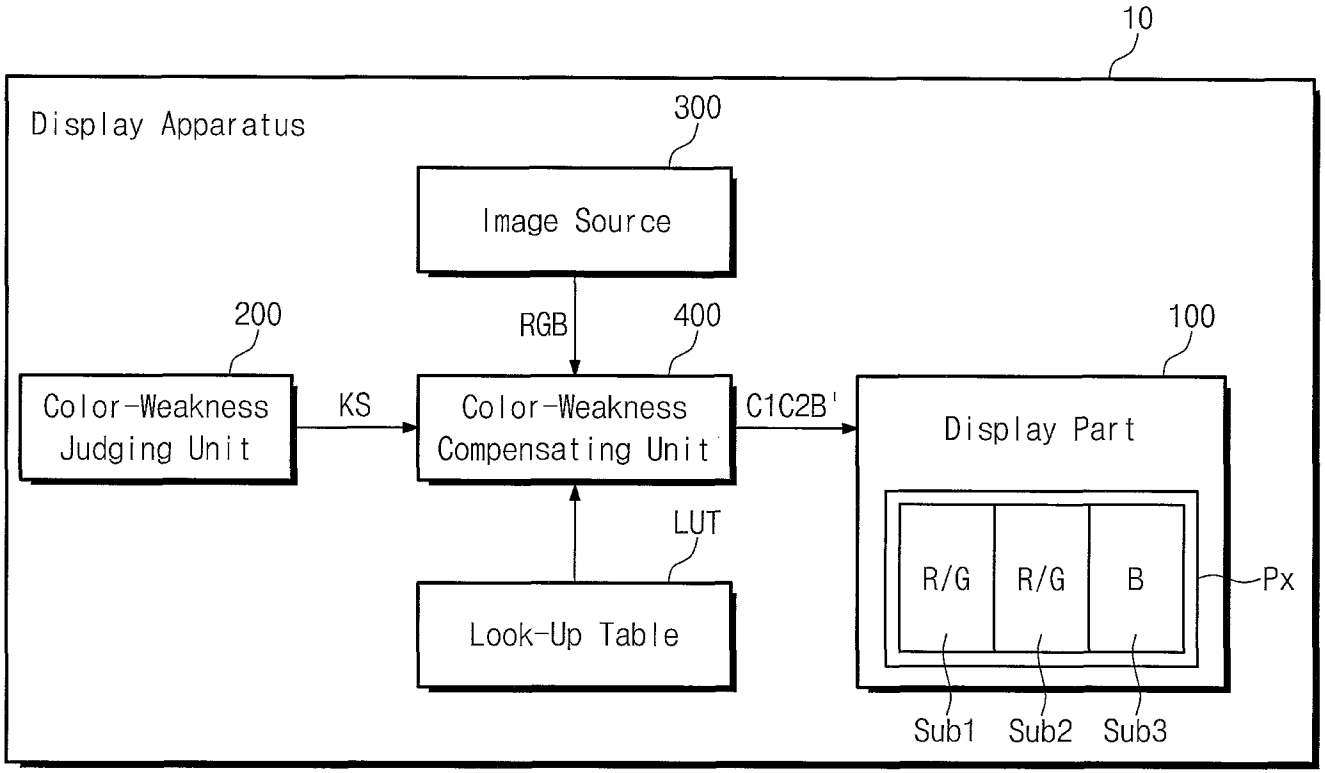
FIG. 1 is a block diagram showing a display device according to an exemplary embodiment.

It will be understood that when an element or layer is referred to as being "on", "connected to" or "coupled to" another element or layer, it can be directly on, connected or coupled to the other element or layer or intervening elements or layers can be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the teens first, second, etc. can be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the described technology.

Spatially relative terms, such as "beneath", "below", "lower", "above", "upper" and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device can be otherwise oriented (rotated 90 degrees or at other orientations) and the spatially relative descriptors used herein interpreted accordingly.

The terminology used herein is for the purpose of describing particular embodiments only and is not intended to be limiting of the described technology. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this described technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the described technology will be explained in detail with reference to the accompanying drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 is a block diagram showing a display device 10 according to an exemplary embodiment. Depending on embodiments, certain elements may be removed from or additional elements may be added to the display device 100 illustrated in FIG. 1. Furthermore, two or more elements may be combined into a single element, or a single element may be realized as multiple elements. This applies to the remaining apparatus embodiments.

Referring to FIG. 1, the display device 10 includes a display portion 100, a color-weakness judging unit or color-weakness determiner 200, an image source 300, and a color-weakness compensating unit or color-weakness compensator 400.

The color-weakness judging unit 200 obtains color-weakness (i.e., dyschromatopsia) information of a user and generates color vision deficiency data KS including the color-weakness information. The color-weakness judging unit 200 secures the color-weakness information of the user using various algorithms, e.g., D-15 panel test, pseudoisochromatic plates test, etc. When the user arranges fifteen color plates different from each other in similar color order, the D-15 panel test analyzes the color plates arranged by the user and obtains the color-weakness information of the user. The pseudoisochromatic plates test obtains the color-weakness information in accordance with how the user perceives numerals on a color perception test chart.

The color-weakness judging unit 200 obtains color vision deficiency type data K and compensation sensitivity data S and generates the color vision deficiency data KS including the obtained data K and S. Here, the color vision deficiency type data K are data about a type of colors, e.g., a red deficiency (protanopia), a green deficiency (deuteranopia), in which the user has difficulty recognizing the colors, and the compensation sensitivity data S is data about a degree of difficulty of recognition of the colors to the user. The color-weakness judging unit 200 that generates the color vision deficiency data KS through the color-weakness test algorithms will be described in detail with reference to FIGS. 2, 3A, and 3B. The color-weakness judging unit 200 applies the color vision deficiency data KS to the color-weakness compensating unit 400.

The image source 300 generates image data RGB including red (R), green (G), and blue (B) and applies the image data RGB to the color-weakness compensating unit 400. The image data RGB corresponds to data in an RGB color space, which includes red, green, and blue colors as a base configuration. The RGB color space combines colors using an method used to obtain the white color by combining three primary colors, i.e., red, green, and blue colors.

The color-weakness compensating unit 400 receives the image data RGB from the image source 300 and receives the color vision deficiency data KS from the color-weakness judging unit 200. The color-weakness compensating unit 400 generates compensation data C1C2B' using the image data RGB and the color vision deficiency data KS.

For example, the color-weakness compensating unit 400 compensates for the image data RGB on the basis of the color vision deficiency data KS. To this end, the color-weakness compensating unit 400 refers to a look-up table LUT in which a color-weakness compensation matrix corresponding to the color vision deficiency data KS is stored. The look-up table LUT is stored in a memory (not shown) included in the display device 10.

The color-weakness compensating unit 400 refers to the look-up table LUT to obtain the color-weakness compensation matrix corresponding to the color vision deficiency data KS provided from the color-weakness judging unit 200. The color-weakness compensating unit 400 performs a matrix calculation on the color-weakness compensation matrix and the image data RGB provided from the image source 300 to generate intermediate data. In addition, the color-weakness compensating unit 400 processes the intermediate data to correspond to sub-pixels Sub1, Sub2, and Sub3 included in a display portion 100 to generate the compensation data C1C2B'. The color-weakness compensating unit 400 applies the compensation data C1C2B' to the display portion 100. The color-weakness compensating unit 400 that generates the compensation data C1C2B' will be described in detail with reference to FIGS. 4, 5A, and 5B.

The display portion 100 receives the compensation data C1C2B' and displays an image on the basis of the compensation data C1C2B'. The display portion 100 includes various elements, such as a timing controller, a data driver, a gate driver, a display panel, etc., to display the image. The display panel includes a plurality of pixels arranged thereon to emit light. Each pixel Px includes the first, second, and third sub-pixels Sub1, Sub2, and Sub3. The first and second sub-pixels Sub1 and Sub2 can be a color control pixel in which color and brightness of the light emitted therefrom are controlled in response to an electric field applied thereto. The third sub-pixel Sub3 can be a blue pixel in which brightness of the light emitted therefrom are controlled in response to an electric field applied thereto. The display portion 100 will be described in detail with reference to FIGS. 5A, 5B, and 6 to 8.

FIG. 1 shows the block diagram of the display device 10 according to an exemplary embodiment and the blocks separated from each other are determined depending on functions of elements included in the display device 10. Therefore, the above-mentioned elements can be embodied in one or more chips and realized by one or more hardware devices. In addition, the above-mentioned elements can share the same hardware device to carry out their functions.

Figure 2:
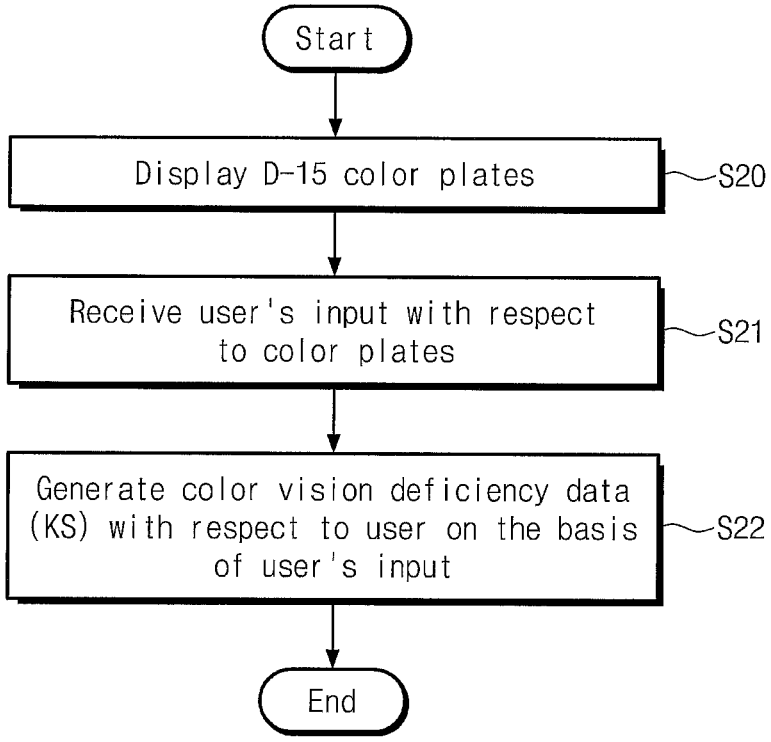
FIG. 2 is a flowchart showing an operation of a display device to generate color vision deficiency data using D-15 panel test.

FIG. 2 is a flowchart showing an operation of a display device to generate the color vision deficiency data KS using the D-15 panel test.

In some embodiments, the FIG. 2 procedure is implemented in a conventional programming language, such as C or C++ or another suitable programming language. The program can be stored on a computer accessible storage medium of the display device 10, for example, a memory (not shown) of the display device 10 or the timing controller 110 (see FIG. 6). In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9×/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 2. The description of this paragraph applies to the embodiments shown in FIGS. 3A, 3B and 4.

Referring to FIG. 2, the display portion 100 displays D-15 color plates. For example, the display portion 100 randomly arranges the fifteen color plates different from each other and displays the fifteen color plates (S20).

Then, the color-weakness judging unit 200 receives inputs given by the user with respect to the arrangement of the color plates displayed on the display portion 100 (S21). The color-weakness judging unit 200 receives the inputs given by the user who arranges the fifteen color plates randomly arranged in similar color order. To this end, the color-weakness judging unit 200 can include a user input portion. The user input portion includes various sensors to receive the user's inputs, e.g., a touch input, a gesture input, a button input, etc.

The color-weakness judging unit 200 generates the color vision deficiency data KS of the user on the basis of the user's inputs (S22). The color-weakness judging unit 200 compares the arrangement of the color plates displayed on the display portion 100 and the user's input against the arrangement of the color plates randomly arranged. The color-weakness judging unit 200 then analyzes the user's input against the arrangement of the color plates to obtain data related to the type of color vision deficiency of the user and data related to the degree of difficulty for recognition of the colors to the user. That is, the color-weakness judging unit 200 analyzes the user's input with respect to the arrangement of the color plates to secure the color vision deficiency type data K and the compensation sensitivity data S. The color-weakness judging unit 200 generates the color vision deficiency data KS including the obtained color vision deficiency type data K and the obtained compensation sensitivity data S.

Figure 3A:
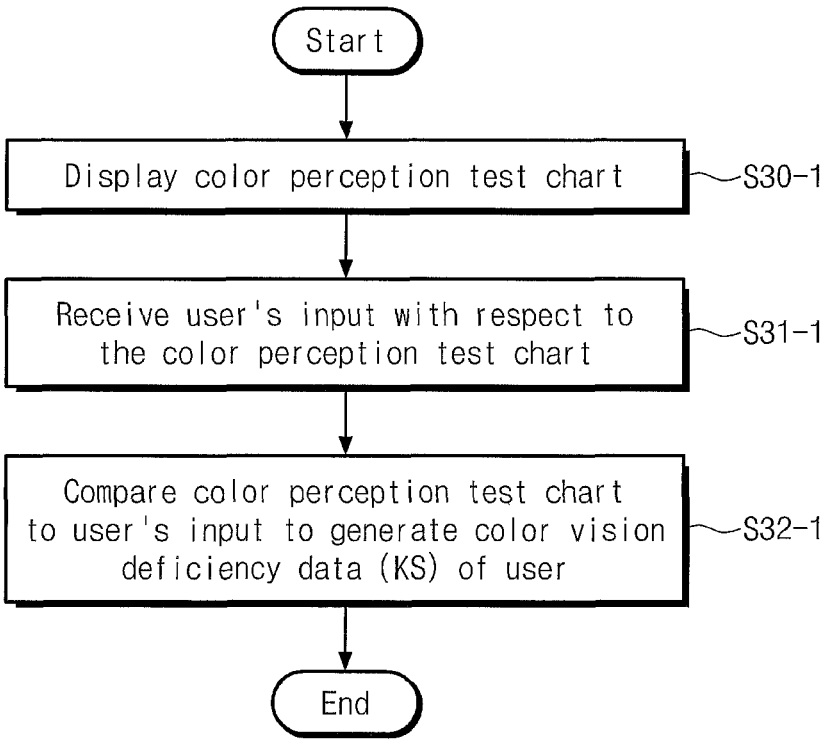
FIGS. 3A and 3B are flowcharts showing an operation of a display device to generate color vision deficiency data using pseudoisochromatic plates test.
Figure 3B:
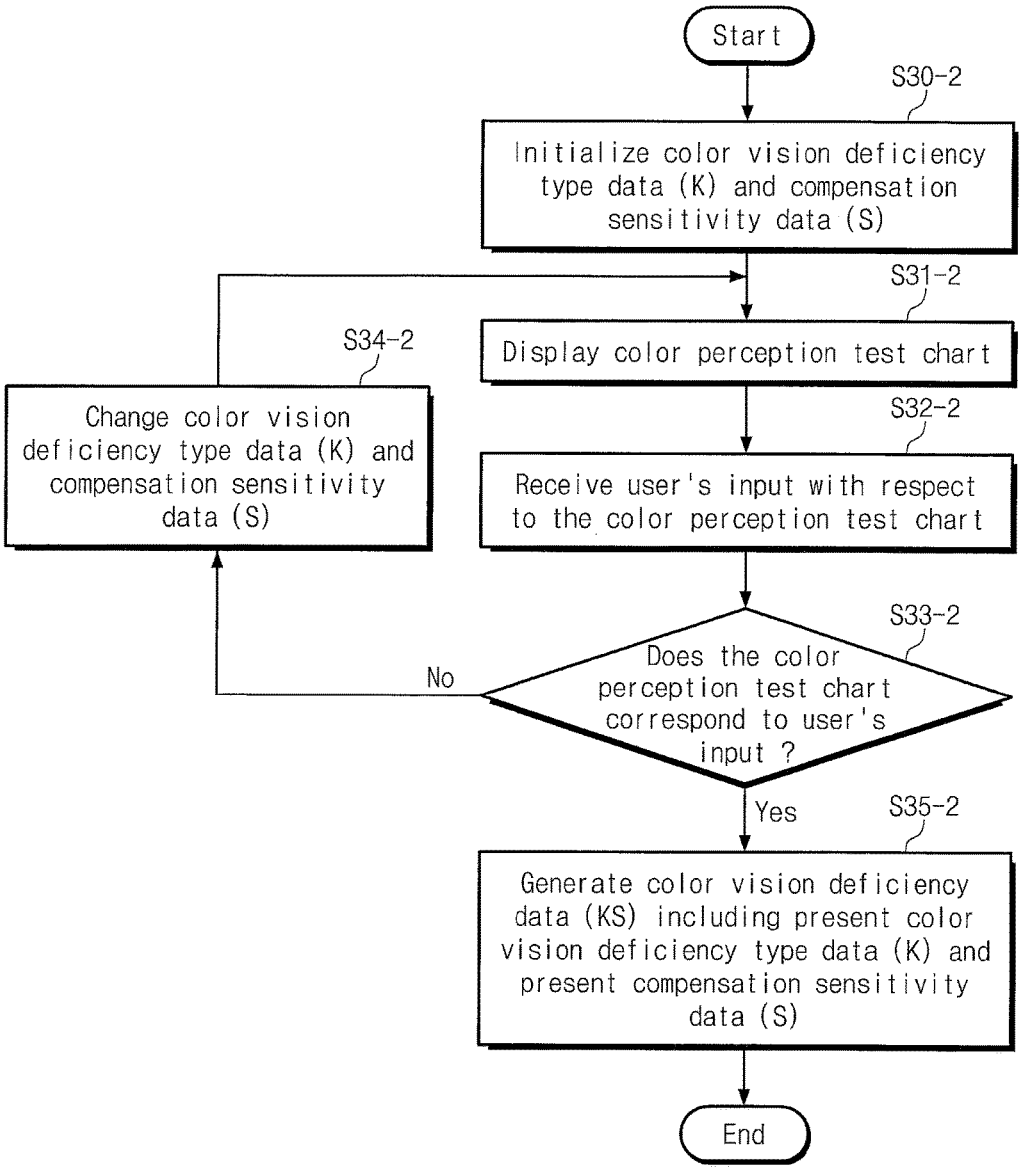

FIGS. 3A and 3B are flowcharts showing an operation of the display device to generate the color vision deficiency data using pseudoisochromatic plates test.

Referring to FIG. 3A, the display portion 100 displays the color perception test chart (S30-1). The color perception test chart includes numerals represented by various colors and printed thereon to test the color-weakness.

Then, the color-weakness judging unit 200 receives input given by the user against the color perception test chart displayed on the display portion 100 (S31-1). For example, the color-weakness judging unit 200 receives number input given by the user, which correspond to the color perception test chart.

The color-weakness judging unit 200 compares the displayed color perception test chart on the display portion 100 and the user's input against the displayed color perception test chart and generates the color vision deficiency data KS of the user (S32-1). For example, the color-weakness judging unit 200 obtains data related to the type of color vision deficiency of the user and data related to the degree of difficulty for recognition of the colors to the user in accordance with whether numbers printed on the color perception test chart are equal to the numbers input by the user. The color-weakness judging unit 200 generates the color vision deficiency data KS including the obtained color vision deficiency type data K and the obtained compensation sensitivity data S.

However, in the present exemplary embodiment, the color-weakness judging unit 200 can generate the color vision deficiency data KS by performing the color-weakness test plural times, which is different from that of the D-15 panel test.

Referring to FIG. 3B, the color-weakness judging unit 200 initializes the color vision deficiency type data K and the compensation sensitivity data S included in the color vision deficiency data KS (S30-2). For instance, the color-weakness judging unit 200 initializes the color vision deficiency type data K and the compensation sensitivity data S to 0.

Then, the display portion 100 displays the color perception test chart (S31-2).

The color-weakness judging unit 200 receives the input given by the user with respect to the color perception test chart displayed on the display portion 100 (S32-2).

After that, the color-weakness judging unit 200 determines whether the numbers printed on the color perception test chart displayed on the display portion 100 are equal to the numbers input by the user.

When the numbers printed on the color perception test chart displayed on the display portion 100 are equal to the numbers input by the user, the color-weakness judging unit 200 generates the color vision deficiency data KS including present color vision deficiency type data K and present compensation sensitivity data S (S35-2).

For instance, since the color vision deficiency type data K and the compensation sensitivity data S are initialized to 0 (S30-2) and the color vision deficiency type data K and the compensation sensitivity data S are not changed in the above-mentioned steps, each of the present color vision deficiency type data K and present compensation sensitivity data S is 0. The color-weakness judging unit 200 generates the color vision deficiency data KS including the color vision deficiency type data K and the compensation sensitivity data S, each having a value of 0 as data.

On the contrary, when the numbers printed on the color perception test chart displayed on the display portion 100 are not equal to the numbers input by the user, the color-weakness judging unit 200 changes the color vision deficiency type data K and the compensation sensitivity data S in accordance with the compared result (S34-2). For example, the color-weakness judging unit 200 changes the color vision deficiency type data K in response to the color vision deficiency type checked on the basis of the color perception test chart.

For instance, when the color perception test chart, which does not correspond to the user's input, is a color perception test chart for the red deficiency, the color-weakness judging unit 200 changes the color vision deficiency type data K to 1. As another example, when the color perception test chart, which does not correspond to the user's input, is a color perception test chart for the green deficiency, the color-weakness judging unit 200 changes the color vision deficiency type data K to 2. In addition, the color-weakness judging unit 200 can perform a calculation on the compensation sensitivity data S to add 1 to the compensation sensitivity data S, thereby changing the compensation sensitivity data S. In this case, since the compensation sensitivity data S is initialized to 0 in the initializing of the data K and S (S30-2), the compensation sensitivity data S is changed to 1.

When the color vision deficiency type data K and the compensation sensitivity data S are changed, the color-weakness test returns to the displaying of the color perception test chart (S31-2). Accordingly, the color vision deficiency type data KS is determined to have an integer number from 0 to 2, and the compensation sensitivity data S increases as the number in which the color perception test chart is not equal to the user's input becomes more frequent.

As described above, the color-weakness judging unit 200 generates the color vision deficiency data KS through various algorithms using the pseudoisochromatic plates test, but it should not be limited thereto or thereby.

Figure 4:
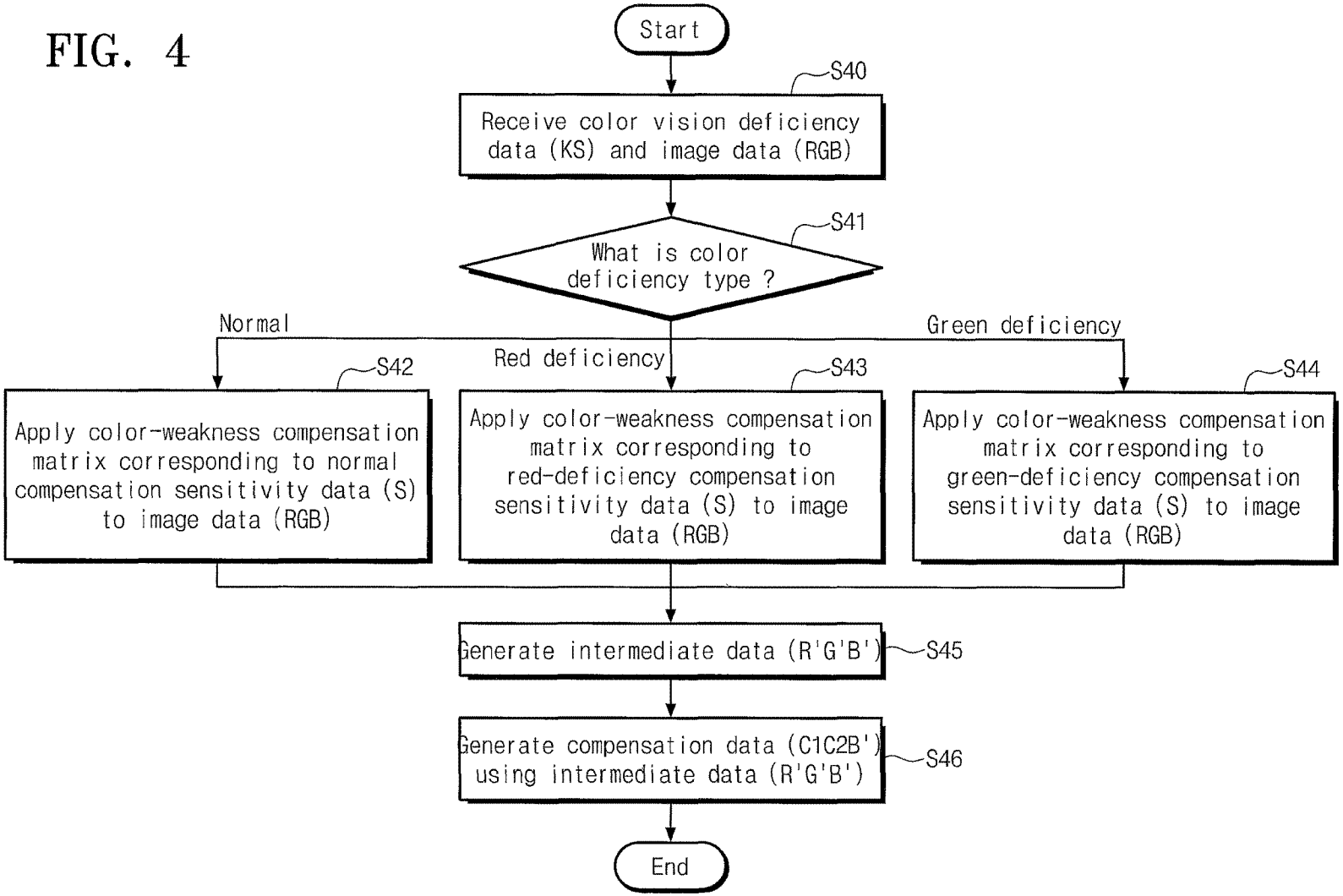
FIG. 4 is a flowchart showing an operation of a display device to generate compensation data.

FIG. 4 is a flowchart showing an operation of a display device to generate the compensation data. FIG. 5A is view showing the look-up table storing the color-weakness compensation matrix corresponding to color vision deficiency data. FIG. 5B is a view showing a determinant to generate the intermediate data using the image data.

Referring to FIG. 4, the color-weakness compensating unit 400 receives the color vision deficiency data KS and the image data RGB (S40). For example, the color-weakness compensating unit 400 receives the color vision deficiency data KS generated by the color-weakness judging unit 200 and the image data RGB generated by the image source 300.

Then, the color-weakness compensating unit 400 determines the color vision deficiency type (S41). The color-weakness compensating unit 400 determines the color vision deficiency type using the color vision deficiency data KS from the color weakness judging unit 200. For instance, when the compensation sensitivity data S or the color vision deficiency type data K is 0, the color-weakness compensating unit 400 determines that the user is in a normal state. When the color vision deficiency type data K is 1, the color-weakness compensating unit 400 determines that the user has the red deficiency. When the color vision deficiency type data K is 2, the color-weakness compensating unit 400 determines that the user has the green deficiency.

When the user is in the normal state, the color-weakness compensating unit 400 applies the color-weakness compensation matrix corresponding to the compensation sensitivity data S of the normal state to the image data RGB (S42). When the user has the red deficiency, the color-weakness compensating unit 400 applies the color-weakness compensation matrix corresponding to the compensation sensitivity data S of the red deficiency to the image data RGB (S43). When the user has the green deficiency, the color-weakness compensating unit 400 applies the color-weakness compensation matrix corresponding to the compensation sensitivity data S of the green deficiency to the image data RGB (S44).

In this case, the color-weakness compensating unit 400 refers to the look-up table LUT in which the color-weakness compensation matrix corresponding to the color vision deficiency data KS is stored.

Referring to FIG. 5A, the look-up table LUT stores the color-weakness compensation matrix corresponding to the color vision deficiency data KS. The color-weakness compensation matrix can be inverse matrices of a daltonize matrix. The daltonize matrix is used as a matrix compensating for the image data RGB to allow a normal user to recognize the colors as people with color vision deficiencies, such as color-weakness. Accordingly, the daltonize inverse matrix can be used as a matrix compensating for the image data RGB to allow people with color vision deficiencies to recognize the colors as the normal user.

When the inverse matrix is applied to the daltonize matrix, the matrix has an element greater than 1. For example, in the daltonize matrix, the matrix element corresponding to the color, which is difficult to be perceived by the color vision deficiency people, has a value greater than 1. Therefore, when the image data RGB are calculated with the daltonize inverse matrix to compensate for the color-weakness, the data corresponding to the color vision deficiency people have values more increased than those of original data.

In this case, when the display device is a light-receiving type display device such as a liquid crystal display, there is a limitation to increase brightness of the color, which is difficult to be perceived by the people with color vision deficiency, in response to the compensated image data. Thus, a typical light-receiving type display device carries out the color-weakness compensation by decreasing brightness of colors, which is easy to be perceived by the people with color vision deficiency, and maintaining the brightness of the color, which is difficult to be perceived by the people with color vision deficiency. As a result, the brightness of the image displayed on a screen is lowered overall.

On the contrary, when the display device is a light-emitting type display device such as an OLED display, the brightness of the color, which is difficult to be perceived by the people with color vision deficiency, can be increased, but there is a limitation to how much the brightness is increased and a lifespan of the light-emitting device is shortened.

However, the display device 10 according to some embodiments includes the pixels, each of which includes the sub-pixels Sub1, Sub2, and Sub3 for the color control, and thus the display device 10 increases the brightness of the color, which is difficult to be perceived by the people with color vision deficiency. In addition, since the display device 10 according to some embodiments can effectively increase the brightness of the color, which is difficult to be perceived by the color vision deficiency people, using the sub-pixels Sub1, Sub2, and Sub3 for the color control, there is no limitation of how much the brightness is increased and the lifespan of the light-emitting device is not shortened.

The color-weakness compensating unit 400 extracts one matrix corresponding to the color vision deficiency data KS among the matrices stored in the look-up table LUT. For instance, when the color vision deficiency type data K is 2 and the compensation sensitivity data S is 2 among the color vision deficiency data KS, the color-weakness compensating unit 400 extracts a three-by-three matrix M1 having elements of [1.37, −0.5, 0.13; −0.13, 1.18, −0.05; 0, 0, 1] among the daltonize inverse matrices. The color-weakness compensating unit 400 calculates the extracted matrix M1 and the image data RGB and generates the intermediate data R'G'B'.

As another example, when the color vision deficiency type data K is 0 and the compensation sensitivity data S is 0 among the color vision deficiency data KS, i.e., the user is in the normal state, the color-weakness compensating unit 400 extracts a three-by-three matrix M1 having elements of [1, 0, 0; 0, 1, 0; 0, 0, 1] among the daltonize inverse matrices. The color-weakness compensating unit 400 calculates the extracted matrix and the image, data RGB to generate the intermediate data R'G'B'. In this case, the image data RGB can be substantially the same as the intermediate data R'G'B'.

Referring to FIG. 5B, the color-weakness compensating unit 400 performs a matrix-calculation on the extracted color-weakness compensation matrix and the image data RGB to generate the intermediate data R'G'B'. In this case, the image data RGB is a three by one matrix having red, green, and blue data as elements and calculated with the color-weakness compensation matrix. The color-weakness compensating unit 400 calculates the image data RGB converted into a matrix form with the color-weakness compensation matrix to generate the intermediate data R'G'B' of the three by one matrix. The calculated intermediate data R'G'B' in the matrix form include the compensated red data R', the compensated green data G', and the compensated blue data B' as their elements, and the compensated red data R', the compensated green data G', and the compensated blue data B' respectively correspond to the elements.

In this case, the compensated red data R', the compensated green data G', and the compensated blue data B' of the intermediate data R'G'B' have a negative value less than 0. The color-weakness compensating unit 400 recognizes the data having the negative integer number while processing the data.

Referring to FIG. 4 again, the color-weakness compensating unit 400 performs a next step following the steps S42 to S44 to generate the compensation data C1C2B' using the intermediate data R'G'B' (S45). The color-weakness compensating unit 400 processes the intermediate data R'G'B' to correspond to the first and second sub-pixels Sub1 for the color control and Sub2 and the third sub-pixel Sub3 for the blue pixel and generates the compensation data C1C2B' (S46).

The color-weakness compensation unit 400 generates the compensation data C1C2B' by applying the intermediate data R'G'B' to a predetermined equation. The compensation data C1C2B' include data about voltages applied to electrodes of the first to third sub-pixels Sub1 to Sub3. For example, the compensation data C1C2B' includes second electrode data to determine a light-emitting color of the first and second sub-pixels Sub1 and Sub2, a color control electrode data to determine brightness of the first and second sub-pixels Sub1 and Sub2, and the compensated blue data B' to determine brightness of the third sub-pixel Sub3. Here, the compensated blue data B' can be substantially the same as the compensated blue data included in the intermediate data R'G'B'.

The compensation data C1C2B' will be described in detail with reference to FIGS. 6 to 8.

Figure 6:
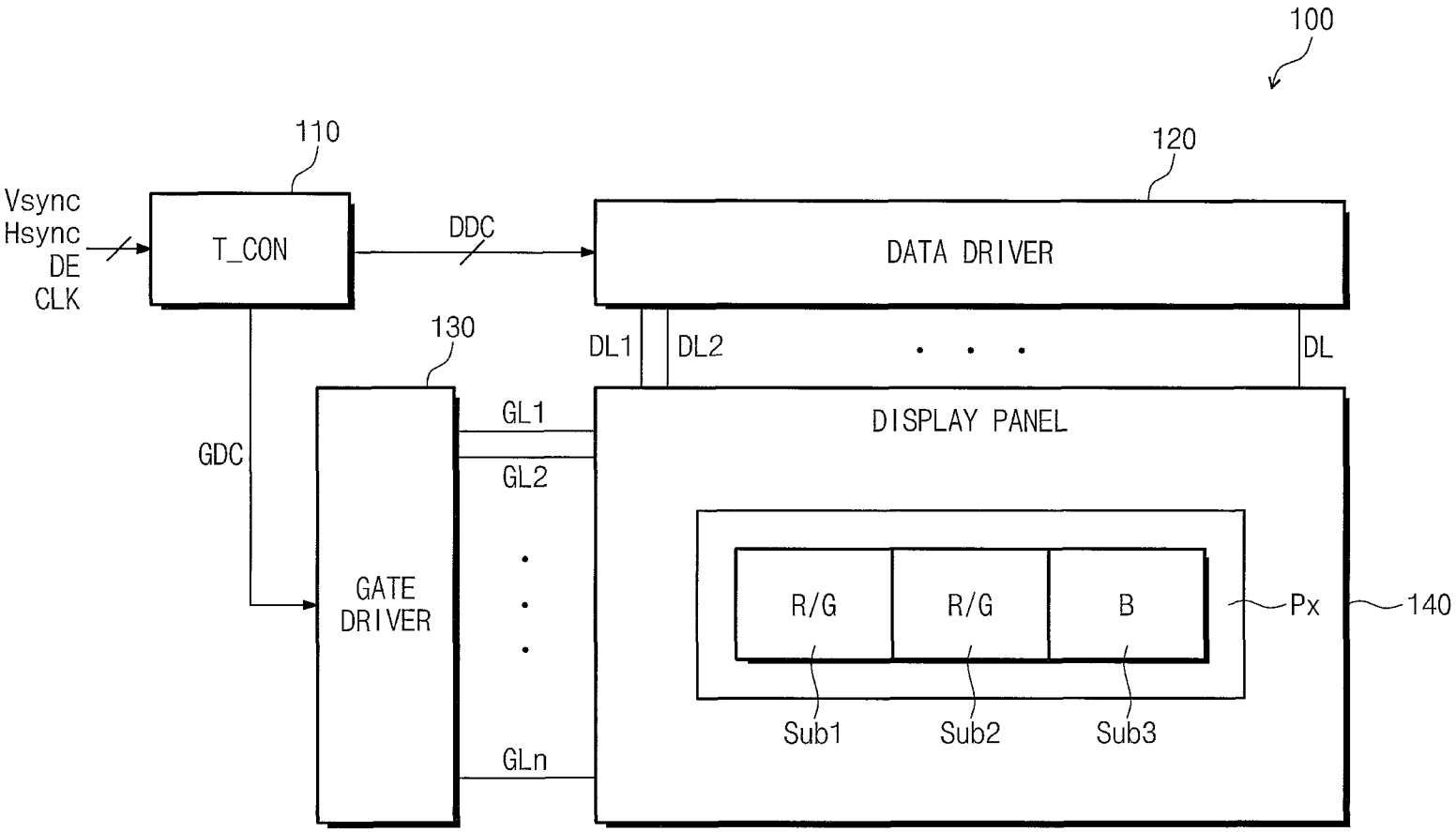
FIG. 6 is a plan view showing a display part according to an exemplary embodiment.

FIG. 6 is a plan view showing the display portion 100 according to an exemplary embodiment.

Referring to FIG. 6, the display portion 100 includes a display panel 140, a timing controller 110, a data driver 120, and a gate driver 130.

The timing controller 110 generates a data control signal DDC to control an operation timing of the data driver 120 and a gate control signal GDC to control an operation timing of the gate driver 130 on the basis of timing signals, such as a vertical synchronization signal Vsync, a horizontal synchronization signal Hsync, a clock signal CLK, a data enable signal DE, etc.

The data driver 120 generates data signals in response to the data control signal DDC provided from the timing controller 110. The data driver 120 applies the data signals to the pixels included in the display panel 140 through data lines DL1 to DLn connected thereto.

The gate driver 130 generates gate signals in response to the gate control signal GDC provided from the timing controller 110. The gate driver 130 applies the gate signals to the pixels through gate lines GL1 to GLn connected thereto.

The data lines DL1 to DLn and the gate lines GL1 to GLn are formed on the display panel 140 to cross each other and the pixels are arranged in areas defined in association with the data lines DL1 to DLn and the gate lines GL1 to GLn.

Each of the pixels Px includes three sub-pixels Sub1, Sub2, and Sub3, i.e., first, second, and third sub-pixels Sub1, Sub2, and Sub3.

The third sub-pixel Sub3 emits light with a predetermined color in response to the data signal applied thereto. For instance, the third sub-pixel Sub3 emits the blue light. The third sub-pixel Sub3 can be, but not limited to, a quantum dots light-emitting diode QD-LED or an OLED.

The first and second sub-pixels Sub1 and Sub2 emit light with various colors in response to the data signals applied thereto. For instance, the first sub-pixel Sub1 or the second sub-pixel Sub2 emits light with a specific wavelength in a range from a first wavelength to a second wavelength in response to the data signal applied thereto. The first wavelength corresponds to the green color, e.g., about 500 nm, and the second wavelength corresponds to the red color, e.g., about 800 nm.

Since the first and second sub-pixels Sub1 and Sub2 include the quantum dots light-emitting diode QD-LED, the first and second sub-pixels Sub1 and Sub2 emit the light with various colors by controlling the electric field applied to the first and second sub-pixels Sub1 and Sub2.

Figure 7:
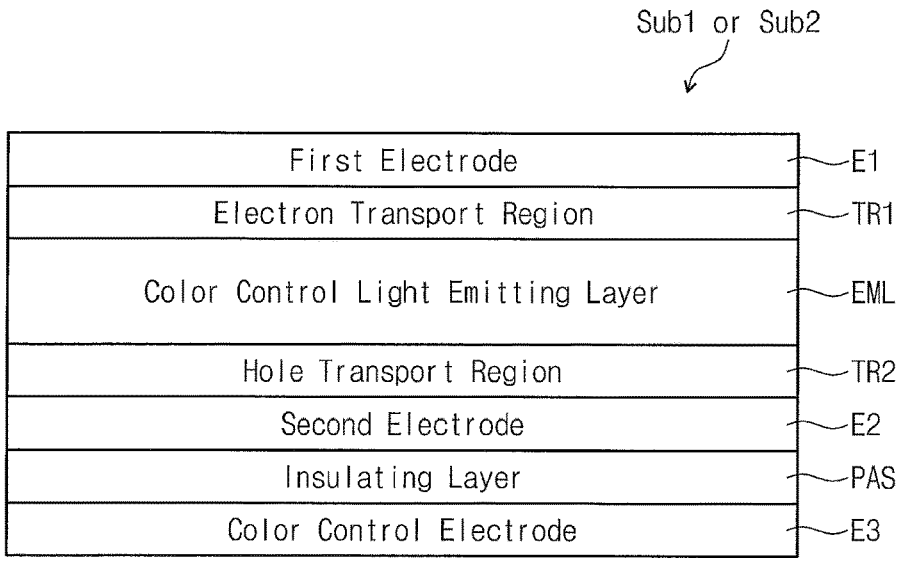
FIG. 7 is a cross-sectional view showing a first or second sub-pixel.

FIG. 7 is a cross-sectional view showing the first or second sub-pixel. FIG. 8 is an energy band gap diagram showing the color control light-emitting layer.

Referring to FIG. 7, each of the first and second sub-pixels Sub1 and Sub2 includes a first electrode E1, an electron transport region TR1, and the color control light-emitting layer EML, a hole transport region TR2, a second electrode E2, an insulating layer PAS, and a color control electrode E3.

The first electrode E1 is a common electrode or a cathode electrode. The first electrode E1 can be a transmissive electrode, a transflective electrode, or a reflective electrode. When the first electrode E1 is the transmissive electrode, the first electrode E1 is formed of Li, Ca, LiF/Ca, LiF/Al, Al, Mg, BaF, Ba, Ag, or a compound or a mixture thereof, e.g., a mixture of Ag and Mg.

The first electrode E1 can include an auxiliary electrode. The auxiliary electrode includes a layer formed by depositing the material toward the color control light-emitting layer EML and a transparent metal oxide formed on the layer, e.g., indium tin oxide (ITO), indium zinc oxide (IZO), zinc oxide (ZnO), indium tin zinc oxide (ITZO), Mo, Ti, etc.

When the first electrode E1 is the transflective electrode or the reflective electrode, the first electrode E1 is formed of Ag, Mg, Al, Pt, Pd, Au, Ni, Nd, Ir, Cr, Li, Ca, LiF/Ca, LiF/Al, Mo, Ti, or a compound or mixture thereof, e.g., a mixture of Ag and Mg. In addition, the first electrode E1 can have a multi-layer structure of a reflective or transflective layer of the material and a transparent conductive layer of ITO, IZO, ZnO, ITZO, etc.

The electron transport region TR1 is formed on the first electrode E1.

The electron transport region TR1 includes at least one of a hole block layer, an electron transport layer, and an electron injection layer, but it should not be limited thereto or thereby. For instance, the electron transport region TR1 has a structure of the electron injection layer/electron transport layer or the electron injection layer/electron transport layer/hole block layer, which are sequentially stacked on the first electrode E1, but the electron transport region TR1 can have a single-layer structure including two or more layers of the above-mentioned layers.

The electron transport region TR1 can be formed by various methods, such as a vacuum deposition method, a spin coating method, a casting method, a Langmuir-Blodgett (LB), an inkjet printing method, a laser printing method, a laser induced thermal imaging (LITI), etc.

When the electron transport region TR1 includes the electron transport layer, the electron transport region TR1 is formed of Alq3(Tris(8-hydroxyquinolinato)aluminum), TPBi(1,3,5-Tri(1-phenyl-1H-benzo[d]imidazol-2-yl)phenyl), BCP(2,9-Dimethyl-4,7-diphenyl-1,10-phenanthroline), Bphen(4,7-Diphenyl-1,10-phenanthroline), TAZ(3-(4-Biphenylyl)-4-phenyl-5-tert-butylphenyl-1,2,4-triazole), NTAZ(4-(Naphthalen-1-yl)-3,5-diphenyl-4H-1,2,4-triazole), tBu-PBD(2-(4-Biphenylyl)-5-(4-tert-butylphenyl)-1,3,4-oxadiazole), BAlq(Bis(2-methyl-8-quinolinolato-N1,O8)-(1,1'-Biphenyl-4-olato)aluminum), Bebq2(berylliumbis(benzoquinolin-10-olate)), ADN(9,10-di(naphthalene-2-yl)anthracene), and a mixture thereof, but it should not be limited thereto or thereby.

The electron transport layer has a thickness in the range of about 100 angstroms to about 1000 angstroms. For example, the thickness can be in the range of about 150 angstroms to about 500 angstroms. When the thickness of the electron transport layer is in the above-mentioned range, superior electron transport characteristics can be obtained without increasing a driving voltage. However, depending on the embodiments, the thickness can be less than about 100 angstroms or greater than about 1000 angstroms.

When the electron transport TR1 includes the electron injection layer, the electron transport region TR1 includes a lanthanum-group metal, e.g., LiF, LiQ (lithium quinolate), Li20, BaO, NaCl, CsF, Yb, etc., or a halide metal, e.g., RbCl, RbI, etc., but it should not be limited thereto or thereby.

The electron injection layer can be formed of a material obtained by mixing an electron transport material with an organic metal salt having insulating property. The organic metal salt has an energy band gap of about 4 ev. For example, the organic metal salt includes metal acetate, metal benzoate, metal acetoacetate, metal acetylacetonate, or metal stearate.

The electron injection layer has a thickness in the range of about 1 angstrom to about 100 angstroms. For example, the thickness can be in the range of about 3 angstroms to about 90 angstroms. When the thickness of the electron injection layer is in the above-mentioned range, superior electron injection characteristics can be obtained without increasing the driving voltage. However, depending on the embodiments, the thickness can be less than about 1 angstrom or greater than about 100 angstroms.

As described above, the electron transport region TR1 can include the hole block layer. The hole block layer can be formed of at least one of BCP(2,9-dimethyl-4,7-diphenyl-1,10-phenanthroline) and Bphen(4,7-diphenyl-1,10-phenanthroline), but it should not be limited thereto or thereby.

The hole block layer has a thickness in the range of about 20 angstroms to about 1000 angstroms. For example, the thickness is in the range of about 30 angstroms to about 300 angstroms. When the thickness of the hole block layer is in the above-mentioned range, superior hole block characteristics can be obtained without increasing the driving voltage. However, depending on the embodiments, the thickness can be less than about 20 angstroms or greater than about 1000 angstroms.

The color control light-emitting layer EML is formed on the electron transport region TR1.

The color control light-emitting layer EML is a quantum dot light-emitting layer including quantum dots each having a diameter in the range of about 1 nm to about 100 nm of 2 group-6 group pair or 3 group-5 group pair nano-semiconductor compound. For instance, the nano-semiconductor compound is any one selected from cadmium selenide (CdSe), cadmium sulfide (CdS), Cadmium telluride (CdTe), zinc selenide (ZnSe), zinc telluride (ZnTe), zinc sulfide (ZnS), mercury telluride (HgTe), indium arsenide (InAs), Cd1-xZnxSe1-ySy', CdSe/ZnS, indium phosphorus (InP), and gallium arsenide (GaAs).

Each quantum dot includes a core, a shell surrounding the core to protect a surface of the core, and a ligand attached to a surface of the shell. The ligand is removed when the quantum dot light-emitting layer is formed.

The color control light-emitting layer EML includes quantum dots, each having a diameter of nanometers, and is formed by providing quantum dots to solvent, coating the solvent, in which the quantum dots are distributed, on the electron transport region TR1 through a solution process, and volatilizing the solvent.

The color control light-emitting layer EML can emit light with various colors in accordance with positions each at which a hole is combined with an electron, which are injected from an external source. For example, the color control light-emitting layer EML emits light with the colors in the range from the first wavelength to the second wavelength in accordance with the positions each at which the hole is combined with the electron in the color control light-emitting layer EML. Here, the first wavelength corresponds to the green color, e.g., about 500 nm, and the second wavelength corresponds to the red color, e.g., about 800 nm. The positions, each at which the hole is combined with the electron in the color control light-emitting layer EML, are controlled by the electric field generated by the color control electrode E3 described later.

The hole transport region TR2 is formed on the color control light-emitting layer EML.

The hole transport region TR2 includes at least one of a hole injection layer, a hole transport layer, a buffer layer, and an electron block layer.

The hole transport region TR2 has a single-layer structure formed of a single material, a single-layer structure formed of different materials, or a multi-layer structure formed of different materials.

For instance, the hole transport region TR2 has the single-layer structure formed of different materials or a structure of the hole transport layer/the hole injection layer, the buffer layer/the hole transport layer/the hole injection layer, the buffer layer/the hole injection layer, the buffer layer/the hole transport layer, or the electron block layer/the hole transport layer/the hole injection layer, but it should not be limited thereto or thereby.

The hole transport region TR2 can be formed by various methods, such as a vacuum deposition method, a spin coating method, a casting method, a Langmuir-Blodgett (LB), an inkjet printing method, a laser printing method, a laser induced thermal imaging (LITI), etc.

When the hole transport region TR2 includes the hole injection layer, the hole transport region TR2 can be formed of phthalocyanine compound of copper phthalocyanine; DNTPD (N,N'-diphenyl-N,N'-bis-[4-(phenyl-m-tolyl-amino)-phenyl]-biphenyl-4,4'-diamine), m-MTDATA(4,4',4"-tris(3-methylphenylphenylamino)triphenylamine), TDATA(4,4'4"-Tris(N,N-diphenylamino)triphenylamine), 2TNATA(4,4',4"-tris{N,-(2-naphthyl)-N-phenylamino}-triphenylamine), PEDOT/PSS(Poly(3,4-ethylenedioxythiophene)/Poly(4-styrenesulfonate)), PANI/DBSA(Polyaniline/Dodecylbenzenesulfonic acid), PANI/CSA(Polyaniline/Camphor sulfonicacid), PANI/PSS((Polyaniline)/Poly(4-styrenesulfonate)), but it should not be limited thereto or thereby.

When the hole transport region TR2 includes the hole transport layer, the hole transport region TR2 includes carbazole-based derivatives, such as N-phenyl carbazole, polyvinyl carbazole, etc., fluorine-based derivatives, triphenylamine-based derivatives, such as TPD(N,N'-bis(3-methylphenyl)-N,N'-diphenyl-[1,1-biphenyl]-4,4'-diamine), TCTA(4,4',4"-tris(N-carbazolyl)triphenylamine), etc., NPB (N,N'-di(1-naphthyl)-N,N'-diphenylbenzidine), and TAPC (4,4'-Cyclohexylidene bis[N,N-bis(4-methylphenyl)benzenamine]), but it should not be limited thereto or thereby.

The hole transport region TR2 has a thickness of about 100 angstroms to about 10000 angstroms. For example, the thickness is in the range of about 100 angstroms to about 1000 angstroms. However, depending on the embodiments, the thickness can be less than about 100 angstroms or greater than about 10000 angstroms. When the hole transport region TR2 includes the hole injection layer and the hole transport layer, the hole injection layer has a thickness in the range of about 100 angstroms to about 10000 angstroms. For example, the thickness is in the range of about 100 angstroms to about 1000 angstroms. However, depending on the embodiments, the thickness can be less than about 100 angstroms or greater than about 10000 angstroms. The hole transport layer has a thickness of about 50 angstroms to about 2000 angstroms. For example, the thickness is in the range of about 100 angstroms to about 1500 angstroms. However, depending on the embodiments, the thickness can be less than about 100 angstroms or greater than about 1500 angstroms. When the thicknesses of the hole transport region TR2, the hole injection layer, and the hole transport layer are in the above-mentioned ranges, superior hole transport characteristics can be obtained without increasing the driving voltage.

The hole transport region TR2 can further include an electric charge generating material to improve the conductivity thereof. The electric charge generating material can be regularly dispersed in the hole transport region TR2. For instance, the electric charge generating material can be a p-dopant, and the p-dopant can be a quinone derivative, a metal oxide, or a cyano group-containing compound, but it should not be limited thereto or thereby.

That is, the p-dopant includes quinone derivatives such as TCNQ(Tetracyanoquinodimethane), F4-TCNQ(2,3,5,6-tetrafluoro-tetracyanoquinodimethane), etc., or the metal oxide such as tungsten oxide, molybdenum oxide, etc., but it should not be limited thereto or thereby.

As described above, the hole transport region TR2 further includes at least one of the buffer layer and the electron block layer in addition to the hole injection layer and the hole transport layer. The buffer layer compensates for a resonance distance in accordance with a wavelength of the light exiting from the color control light-emitting layer EML to enhance the light emission efficiency of the color control light-emitting layer EML. The material included in the hole transport region TR2 can be included in the buffer layer. The electron block layer prevents the electrons from being injected to the hole transport region TR2 from the electron transport region TR1.

The second electrode E2 is formed on the hole transport region TR2.

The second electrode E2 can be a pixel electrode or an anode electrode. The second electrode E2 can be an electric field transmissive electrode. For instance, the second electrode E2 is formed of graphene, metal nano mesh, etc., but it should not be limited thereto or thereby. The second electrode E2 can include various materials as long as it can transmit the electric field. The second electrode E2 transmits the electric field applied by the color control electrode E3, and thus the electric field is applied to the color control light-emitting layer EML.

The insulating layer PAS is formed on the second electrode E2. The insulating layer PAS insulates the second electrode E2 from the color control electrode E3. The insulating layer PAS is formed of an organic or inorganic material.

The color control electrode E3 is formed on the insulating layer PAS.

The color control electrode E3 applies the electric field to the color control light-emitting layer EML to determine the color of the light emitted from the color control light-emitting layer EML. The color control electrode E3 controls intensity of the electric field applied to the color control light-emitting layer EML and applies energy to holes or electrons in the color control light-emitting layer EML, thereby controlling the positions at which the holes are combined with the electrons. When the holes are combined with the electrons, excitons are generated and the light is emitted. The wavelength of the emitting light is controlled in the range from the first wavelength to the second wavelength in accordance with the positions at which the holes are combined with the electrons. Here, the first wavelength is the wavelength corresponding to the green color and the second wavelength is the wavelength corresponding to the red color.

The color control electrode E3 is a cathode or an anode.

When the color control electrode E3 is the cathode, the color control electrode E3 increases the intensity of the electric field applied to the color control light-emitting layer EML to allow the color control light-emitting layer EML to emit the light having the wavelength that is close to the first wavelength. On the contrary, the color control electrode E3 can decrease the intensity of the electric field applied to the color control light-emitting layer EML to allow the color control light-emitting layer EML to emit the light having the wavelength that is close to the second wavelength. That is, when the color control electrode E3 is the cathode, the wavelength of the light emitted from the color control light-emitting layer EML is shortened as the intensity of the electric field generated by the color control electrode E3 increases, and lengthened due to the intensity of the electric field generated by the color control electrode E3.

Figure 8:
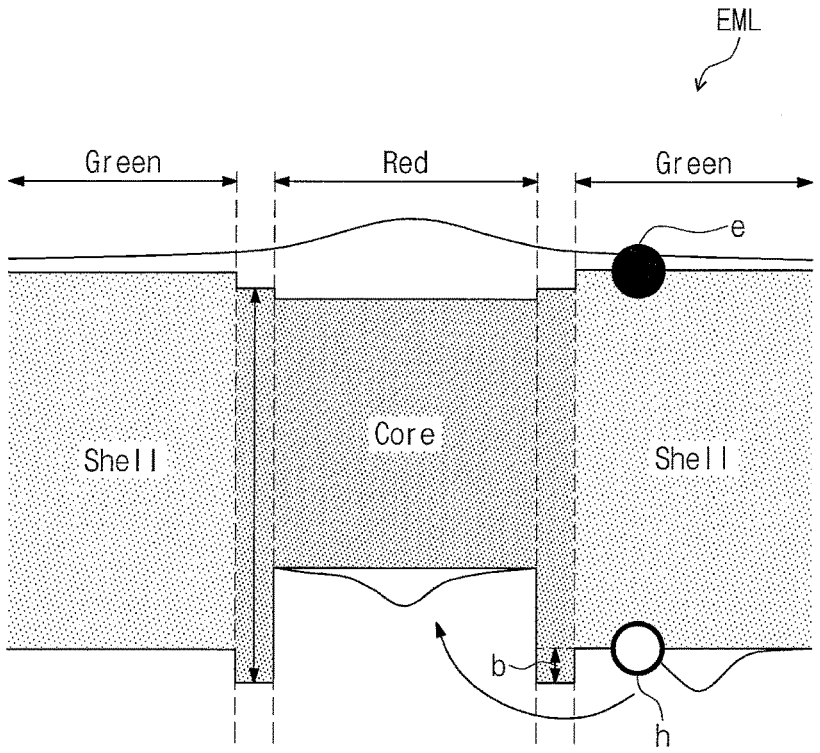
FIG. 8 is an energy band gap diagram showing a color control light-emitting layer.

Referring to FIG. 8, the core exists at the center of the quantum dot included in the color control light-emitting layer EML and the surface of the core is surrounded by the shell. The hole h provided from the hole transport region TR2 and the electron e provided from the electron transport region TR1 are combined with each other in the core or shell.

When the hole h is combined with the electron e in the shell to generate the exciton, the light having the first wavelength is generated when the exciton returns to a ground state from an excited state. When the hole h is combined with the electron e in the core to generate the exciton, the light having the second wavelength is generated when the exciton returns to the ground state from the excited state. Accordingly, as an amount of the exciton generated in the shell, is relatively large, the green-based light is generated, and as an amount of the exciton generated in the core is relatively large, the red-based light is generated.

The core has a HOMO energy level different from that of the shell and a constant energy barrier b exists between the core and the shell. Therefore, the exciton is generally generated in the shell, and thus the green-based light is generated. However, when the number of the holes h, which have energy enough to overcome the energy barrier b, is relatively high, the exciton is generated in the core, and thus the red-based light is generated.

Thus, the color control electrode E3 applies the electric field to the color control light-emitting layer EML to control the energy of the hole h, thereby controlling the position at which the exciton is generated. As a result, the color of the light emitted from the color control light-emitting layer EML can be controlled.

According to FIGS. 6 to 8, the compensation data C1C2B' corresponding to the first to third sub-pixels Sub1 to Sub3 can include second electrode data C1 used to determine the brightness of the first and second sub-pixels Sub1 and Sub2 and color control electrode data C2 used to determine the light-emitting color of the first and second sub-pixels Sub1 and Sub2. In addition, the compensation data C1C2B' can include the blue data B' used to determine the brightness of the third sub-pixel Sub3.

The color-weakness compensating unit 400 applies the intermediate data R'G'B' to a specific equation to generate the compensation data C1C2B'.

In some embodiments, the color-weakness compensating unit 400 applies the intermediate data R'G'B' to the following Equation 1 and calculates the second electrode data C1 included in the compensation data C1C2B'.

$$C1=k1\cdot(R'+G')/2 \quad \text{Equation 1}$$

In Equation 1, C1 denotes the second electrode data, k1 denotes a constant determined depending on the light-emitting efficiency of the color control light-emitting layer EML, R' denotes the compensated red data, and G' denotes the compensated green data.

In addition, the color-weakness compensation unit 400 applies the intermediate data to the following Equation 2 and calculates the color control electrode data C2.

$$C2=k2\cdot(R'/(R'+G'))+k3 \quad \text{Equation 2}$$

In Equation 2, C2 denotes the color control electrode data, k2 denotes a constant determined depending on the light-emitting efficiency of the color control light-emitting layer EML, k3 denotes a constant determined depending on a threshold voltage required to drive the color control light-emitting layer EML, R' denotes the compensated red data, and G' denotes the compensated green data.

The color-weakness compensation unit 400 generates the compensation data C1C2B' including the second electrode data C1, the color control electrode data C2, and the compensated blue data B' and applies the compensation data C1C2B' to the display portion 100. The display portion 100 generates a pixel driving signal using the compensation data C1C2B' and applies the pixel driving signal to each pixel, and thus the display portion 100 displays the image in which the color-weakness is compensated. For instance, the display portion 100 generates the data signals using the compensation data C1C2B' and applies the data signal to the pixels Px, respectively, to thereby display the compensated image for the color vision deficiency people, but it should not be limited thereto or thereby. That is, the display portion 100 can generate various driving signals on the basis of the compensation data C1C2B' and apply the various driving signals to the pixels Px, and thus the display portion 100 can display the compensated image for the color vision deficiency people.

In this case, the brightness of the first and second sub-pixels Sub1 and Sub2 is determined depending on the second electrode data C1 of the compensation data C1C2B', the light-emitting color of the first and second sub-pixels Sub1 and Sub2 is determined depending on the color control electrode data C2 of the compensation data C1C2B', and the brightness of the third sub-pixel Sub3 is determined depending on the compensated blue data B' of the compensation data C1C2B'.

Although the inventive technology has been described, it is understood that the present invention should not be limited to these exemplary embodiments but various changes and modifications can be made by one ordinary skilled in the art within the spirit and scope of the present invention as hereinafter claimed.

What is claimed is:

1. A display device comprising:

an image source configured to generate image data comprising red, green, and blue data;

a color-weakness determiner configured to generate color vision deficiency data comprising color-weakness information;

a color-weakness compensator configured to generate compensation data based on the image data and the color vision deficiency data; and a display portion comprising a plurality of pixels each configured to emit light based on the compensation data, wherein each of the pixels comprises:

first and second sub-pixels configured to emit light having a light-emitting color based on an electric field applied to the first or second sub-pixel; and a third sub-pixel configured to emit light having a predetermined light-emitting color, wherein each of the first and second sub-pixels includes a color control light-emitting layer and a color control electrode, and the color control electrode controls the intensity of the electric field applied to the color control light-emitting layer, and wherein the color control electrode is configured to apply the electric field to the color control light-emitting layer to adjust a light-emitting color of the light to be emitted from the color control light-emitting layer.

2. The display device of claim 1, wherein the color-weakness information comprises dyschromatopsia information of a user of the display device.

3. The display device of claim 1, wherein the color vision deficiency data comprises color vision deficiency type data of a user of the display device and compensation sensitivity data of the user.

4. The display device of claim 3, wherein the color-weakness determiner is further configured to generate the color vision deficiency data based on a panel test algorithm.

5. The display device of claim 4, wherein the panel test algorithm includes a D-15 panel test algorithm configured analyze a plurality of color plates arranged by the user and obtain the color-weakness information of the user.

6. The display device of claim 5, wherein the display portion is configured to display fifteen color plates, and wherein the color-weakness determiner is further configured to i) receive a user input with respect to an arrangement of the color plates displayed on the display portion and ii) generate the color vision deficiency data of the user based on the user input.

7. The display device of claim 3, wherein the color-weakness determiner is further configured to generate the color vision deficiency data based on a pseudoisochromatic plates test algorithm.

8. The display device of claim 7, wherein the display portion is further configured to display a color perception test chart, and wherein the color-weakness determiner is further configured to i) receive a user input with respect to the color perception test chart and ii) compare the user input to the displayed color perception test chart so as to generate the color vision deficiency data of the user.

9. The display device of claim 8, wherein the color-weakness determiner is further configured to:

determine whether the user input corresponds to the color perception test chart, change the compensation sensitivity data and the color vision deficiency type data based on a color vision deficiency type of the user, when the user input does not correspond to the color perception test chart, and generate the color vision deficiency data based on present compensation sensitivity data and present color vision deficiency type data, when the user input corresponds to the color perception test chart.

10. The display device of claim 1, wherein each of the first and second sub-pixels comprises:

a first electrode;

an electron transport region formed over the first electrode;

a color control light-emitting layer formed over the electron transport region;

a hole transport region formed over the color control light-emitting layer;

a second electrode formed over the hole transport region;

an insulating layer formed over the second electrode; and the color control electrode formed over the insulating layer.

11. The display device of claim 10, wherein the color control light-emitting layer comprises a quantum dot light-emitting layer.

12. The display device of claim 10, wherein the second electrode comprises an electric field transmissive electrode.

13. The display device of claim 10, wherein the color control electrode is configured to apply an electric field to the color control light-emitting layer so as to control the light-emitting color of the color control light-emitting layer.

14. The display device of claim 13, wherein the wavelength of the light-emitting color is in the range from a first wavelength to a second wavelength based on the electric field.

15. The display device of claim 14, wherein the first wavelength corresponds to a green color, and wherein the second wavelength corresponds to a red color.

16. The display device of claim 15, wherein the first wavelength is about 500 nm, and wherein the second wavelength is about 800 nm.

17. The display device of claim 15, wherein the light-emitting color of the third sub-pixel is a blue color.

18. The display device of claim 10, wherein the color-weakness compensator is configured to compensate for the image data based on a look-up table including a color-weakness compensation matrix corresponding to the color vision deficiency data.

19. The display device of claim 18, wherein the color-weakness compensator is further configured to:

obtain the color-weakness compensation matrix corresponding to the color vision deficiency data based on the look-up table, calculate the image data based on the color-weakness compensation matrix so as to generate intermediate data, and process the intermediate data such that the intermediate data corresponds to the first to third sub-pixels so as to generate the compensation data.

20. The display device of claim 19, wherein the color-weakness compensation matrix comprises an inverse matrix of a daltonize matrix corresponding to the color vision deficiency data.

21. The display device of claim 19, wherein the intermediate data comprises compensated red, green and blue data.

22. The display device of claim 21, wherein the compensation data comprises second electrode data corresponding to a voltage applied to the second electrode, color control electrode data corresponding to a voltage applied to the color control electrode, and the compensated blue data.

23. The display device of claim 22, wherein the color-weakness compensator is further configured to calculate the second electrode data based on the following Equation 1, $$C1=k1\cdot(R'+G')/2, \qquad \text{Equation 1}$$

where C1 denotes the second electrode data, k1 denotes a constant determined based on the light-emitting efficiency of the color control light-emitting layer, R' denotes the compensated red data, and G' denotes the compensated green data.

24. The display device of claim 22, wherein the color-weakness compensator is further configured to calculate the second electrode data based on the following Equation 2, $$C2=k2\cdot(R'/(R'+G'))+k3, \qquad \text{Equation 2}$$

where C2 denotes the color control electrode data, k2 denotes a constant determined based on the light-emitting efficiency of the color control light-emitting layer, k3 denotes a constant determined based on a threshold voltage required to drive the color control light-emitting layer, R' denotes the compensated red data, and G' denotes the compensated green data.

25. The display device of claim 22, wherein the color-weakness compensator is further configured to:

determine a brightness of the first and second sub-pixels based on the second electrode data, determine the light-emitting color of the first and second sub-pixels based on the color control electrode data, and determine a brightness of the third sub-pixel based on the compensated blue data.

* * * * *